United States Patent [19]

Solovieff

[11] 4,338,804

[45] Jul. 13, 1982

[54] LATCH BOLT OPERATING DEVICE HAVING IMPROVED SHIELD CONSTRUCTION TO DETER PROBE MANIPULATION

[75] Inventor: Paul G. Solovieff, Tustin, Calif.

[73] Assignee: Emhart Industries, Inc., Farmington, Conn.

[21] Appl. No.: 191,279

[22] Filed: Sep. 26, 1980

[51] Int. Cl.[3] ..... E05B 9/04

[52] U.S. Cl. ..... 70/134; 70/417; 70/452; 292/337

[58] Field of Search ..... 70/118–120, 70/133–134, 381, 448, 449, 451, 452, 417; 292/357, 337

[56] References Cited

U.S. PATENT DOCUMENTS

| | | | |
|---|---|---|---|
| 1,523,346 | 1/1925 | Murmann . | |
| 1,661,454 | 3/1928 | Wilson . | |
| 1,876,081 | 9/1932 | Schlage . | |
| 2,327,071 | 8/1943 | Schlage . | |
| 3,628,356 | 12/1971 | Deahl | 70/449 |
| 3,768,284 | 10/1973 | Kent | 70/104 |
| 4,012,929 | 3/1977 | Solovieff | 70/134 |
| 4,109,498 | 8/1978 | Dietrich | 70/449 |

*Primary Examiner*—Robert L. Wolfe

*Attorney, Agent, or Firm*—Mahoney & Schick

[57] ABSTRACT

A door latch construction has exterior and interior operators connected through a latch driving mechanism operable for extending a bolt from a door edge. The exterior operator includes a lock cylinder telescoped by a thickened, hardened metal guard collar with the guard collar longitudinally inwardly abutting a metal shield retaining the shield inwardly against an exterior face of the door. The shield also extends inwardly of the door interior at least partially annularly around a portion of the latch driving mechanism thereby deterring manipulation of the latch driving mechanism by penetration through the door exterior face. The lock cylinder longitudinally inwardly abuts the guard collar so that the guard collar retained between its lock cylinder abutment and its shield abutment is rotatable to deter exterior attack against the overall exterior operator.

10 Claims, 5 Drawing Figures

LATCH BOLT OPERATING DEVICE HAVING IMPROVED SHIELD CONSTRUCTION TO DETER PROBE MANIPULATION

BACKGROUND OF THE INVENTION

This invention relates to an improved shield incorporated in latch bolt operating devices for shielding the latch driving mechanisms thereof to deter probe manipulation from exterior of and through the exterior face of the door. In the preferred embodiment, the unique shield is retained in the exterior operator assembly of the latch construction longitudinally inwardly against an exterior door face by inward abutment of a guard collar, the guard collar, in turn, being retained by inward abutment of the exterior operator lock cylinder. Thus, the shield is retained in the latch construction assembly in a secure manner for efficiently serving its latch driving mechanism shielding purposes.

It is a well known problem of modern times of attempting to maintain residences and businesses secure from surreptitious entry and burglary. One of the most common forms of attack, of course, is through entry and exit doors. Such doors are attempted to be maintained locked and secured by use of various forms of latch constructions, preferably one or more deadbolt constructions.

The latch constructions used will normally include exterior and interior operators mounted, respectively, at exterior and interior faces of the particular door with the operators being connected interiorly of the door to a latch driving mechanism. The latch driving mechanism is, in turn, operably connected to a bolt arranged for extension and retraction from and to a door edge. The exterior operator includes a lock cylinder exposed outwardly of the exterior door face so that the bolt may be locked in extended position to thereby retain the door in a locked position and against intrusion.

Some years ago it became known to illegal intruders and burglars that these various latch constructions retaining doors locked could be violated by somehow severing the latch construction exterior operators at the exterior door face from the remainder of the latch construction assembly and gaining access to the latch driving mechanism of the latch construction. Once the exterior operator was removed and access to the latch driving mechanism obtained, it was a simple matter to manipulate the latch driving mechanism, withdraw the latch construction bolt and place the door in unlocked condition. Furthermore, it was discovered by police authorities that this severing of the latch construction exterior operators including the lock cylinders thereof was quickly accomplished by use of relatively strong bolt cutters and similar tools.

Thus, in order to attempt to frustrate this means of attack, the manufacturers of latch constructions began improving the exterior operators of latch constructions from the strength standpoint. One of the most efficient and economical means of doing so has been the addition of a relatively thick, hardened metal guard collar to the exterior operator. The guard collar is formed and arranged in the exterior operator assembly securely retained surrounding the vital lock cylinder and also extending longitudinally into the door interior beyond the door exterior face.

As a result, any attempted severing of the exterior operators at the exterior door face by the use of bolt cutters and similar cutting tools required a first penetration of the thick, hardened metal guard collar and would thereby frustrate it. Furthermore, it was found that any attempted penetration by severing tools of the guard collars was made even more difficult by mounting the guard collars rotatable in the assembly in the event of any appreciable forces being applied thereto. This was accomplished by mounting the guard collars in the assembly through mere abutments, although secure abutments, with the associated exterior operator parts.

Since having the exterior operator severing means of attack eliminated, it has been more recently discovered that intruders attempting to violate the latch constructions have resorted to the use of probes inserted through the exterior door faces adjacent the latch construction exterior operators and penetrating at various angular positions to the latch construction latch driving mechanisms. Again, if access to the latch driving mechanisms can be obtained by use of such probe penetration and the person doing so is adept at the correct manipulation, it is possible to manipulate the bolts to withdrawn positions and place the particular door in unlocked condition. It is true that this is a somewhat difficult procedure and manipulation access to the correct portion of the latch driving mechanism must be obtained, it still can be accomplished by those having the necessary knowledge and manipulation skills. It is obvious, therefore, that further protection for the latch driving mechanisms of latch constructions is desirable.

OBJECTS AND SUMMARY OF THE INVENTION

It is, therefore, an object of this invention to provide a unique shield construction for a latch bolt operating device which deters surreptitious manipulation of the latch driving mechanism of the latch by probe penetration through the exterior face of the door in which the latch is mounted. In a preferred embodiment, the shield is mounted forming an assembled part of the latch exterior operator against the exterior door face longitudinally inwardly of a lock cylinder and guard collar assembly. The shield extends longitudinally into the interior of the door and around various parts of the latch driving mechanism so as to effectively shield the vital parts of the latch driving mechanism from the probe penetration attack.

It is another object of this invention to provide the shield for a latch bolt operating device as hereinbefore stated which may be efficiently and securely added to the latch assembly with a minimum of alteration of the latch assembly. Again, in a preferred embodiment, the lock cylinder is retained in the exterior operator of the latch assembly by usual fastening means and effectively abuts a guard collar of the exterior operator retaining such guard in assembly. The guard collar, in turn, longitudinally inwardly abuts a part of the shield positioning the shield against the exterior door face and extending inwardly interiorly of the door to effectively shield the parts of the latch driving mechanism. Thus, through a series of abutment relationships, all of the lock cylinder, the guard collar and the shield are efficiently retained securely in assembly by the usual lock cylinder fastening means.

It is still a further object of this invention to provide a shield for a latch bolt operating device of the foregoing general character which, according to a specific embodiment thereof, cooperates in the assembly with the lock cylinder to securely mount the guard collar operable in its most effective manner. Still again in a preferred embodiment, the guard collar is retained in the exterior operator assembly of the latch surrounding the lock cylinder and overlying the shield by cooperable abutments and solely by such cooperable abutments. In other words, the lock cylinder secured in the exterior operator assembly by the usual fastening means retains the guard collar by abutment inwardly abuttingly against and retaining the shield, and with the guard collar solely retained by such abutments, it is readily rotatable in the assembly upon forces being directed thereagainst creating such rotation. For this reason, the guard collar can resist penetration and destruction in attempts to disassemble the exterior operator through the hardened metal composition thereof, while at the same time, it is extremely difficult to grip for any of such penetration and destruction purposes due to the ready reactive rotation thereof all of which are a part of its maximum effective guarding manner.

Other objects and advantages of the invention will be apparent from the following specification and the accompanying drawings which are for the purpose of illustration only.

DESCRIPTION OF THE BEST EMBODIMENTS CONTEMPLATED

Figure 1:
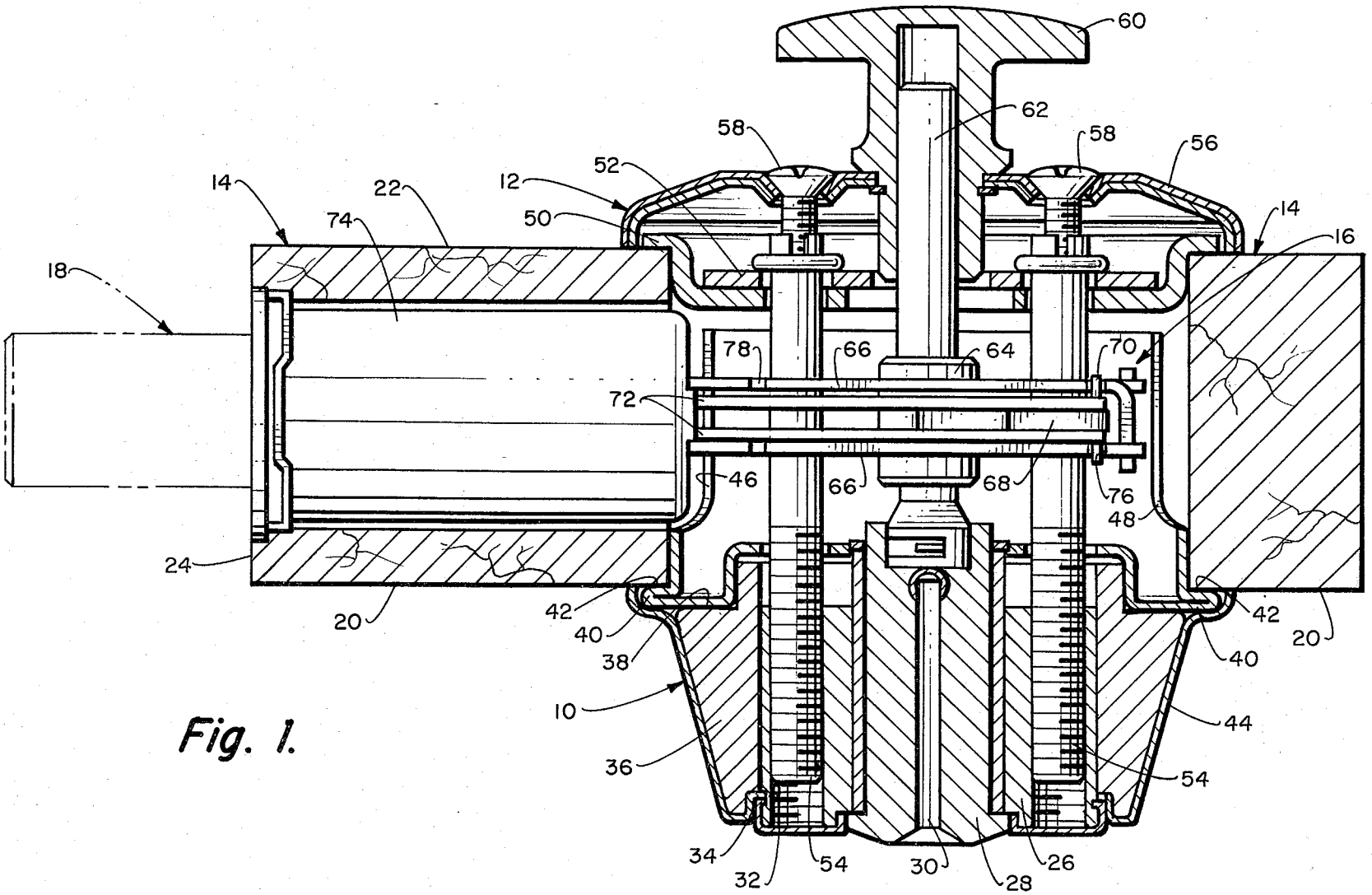
FIG. 1 is a fragmentary, horizontal sectional view of a door mounted deadbolt latch construction incorporating a first preferred embodiment of the unique shield construction of the present invention.

Referring to FIG. 1 of the drawings, a deadbolt latch construction is shown incorporating a first preferred embodiment of the unique shield of the present invention, the latch construction being door mounted in typical operable manner. As shown, the latch construction includes an exterior operator generally indicated at 10 and an interior operator generally indicated at 12 both of which are operably connected interiorly of door 14 to a latch driving mechanism generally indicated at 16 which, in turn, is operably connected for extending and retracting a typical deadbolt generally indicated at 18 shown in phantom lines in extended position. The exterior operator 10 projects longitudinally both outwardly and inwardly of a door exterior surface 20, while the interior operator 12 projects both longitudinally outwardly and inwardly of a door interior surface 22, the deadbolt 18 being extendable from and retractable into a door edge 24.

More specifically, the exterior operator 10 includes a typical lock cylinder 26 telescoping and rotatably mounting a usual lock plug 28 having a key slot 30. At its longitudinal extremity, the lock cylinder 26 is formed with an annular, transversely outwardly extending abutment shoulder 32 which longitudinally inwardly abuts an annular recess 34 of a transversely thickened and hardened metal guard collar 36. The guard collar 36 telescopes the lock cylinder 26 and has a portion adjacent the lock cylinder extending longitudinally inwardly of the door exterior surface 20 into the interior of the door, and equally importantly has an inner transversely extending abutment shoulder 38 longitudinally inwardly abutting a matching surface of an annular metal shield 40 which is partially longitudinally outwardly of and partially longitudinally inwardly of the interior of the door 14.

Figure 2:
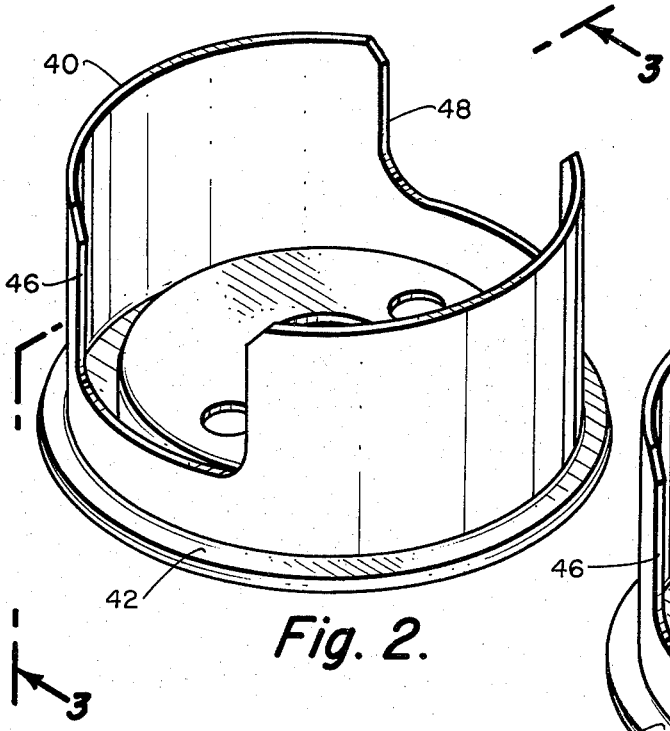
FIG. 2 is a reduced, perspective view of the shield removed from the assembly of FIG. 1.
Figure 3:
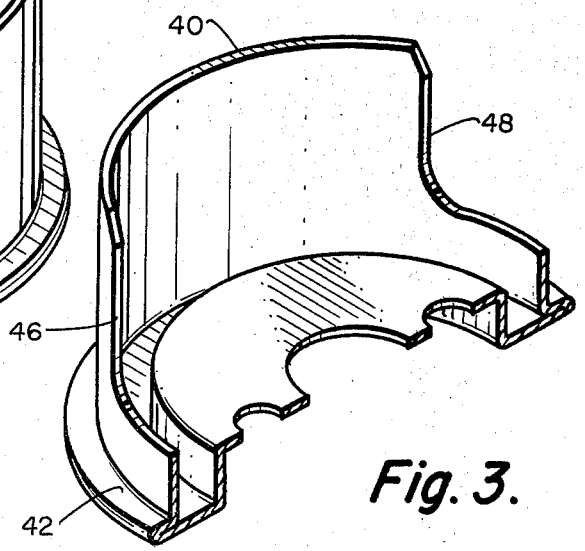
FIG. 3 is a sectional view looking in the direction of the arrows 3—3 in FIG. 2.

The shield 40 is a first preferred embodiment of the improved shield construction of the present invention and is shown in assembly in FIG. 1 and separately in FIGS. 2 and 3. In shape, the shield 40 extends annularly, transversely inwardly from outwardly overlying the door exterior surface 20 into its abutment with the guard collar abutment shoulder 38 and then continues longitudinally inwardly and again transversely inwardly along the remainder of the guard collar 36 finally projecting inwardly of and spaced longitudinally inwardly from a major part of the lock cylinder 26 to transversely outwardly of the lock plug 28. At its transverse outward extremity longitudinally outwardly overlying the door exterior surface 20, the shield 40 folds transversely inwardly to provide an annular abutment shoulder 42 longitudinally inwardly abutting the door exterior surface 20 and then extends longitudinally inwardly interiorly of the door 14 extending longitudinally a major part of the interior of the door. A decorative annular cover 44 covers all of the outwardly exposed portions of the lock cylinder 26, the guard collar 36 and the shield 40 inwardly to the door exterior surface 20.

Spaced longitudinally inwardly interiorly of the door 14 and at the bolt side of the latch construction, the shield 40 is formed with a radial cutout 46 having a portion of the latch driving mechanism 16 extending therethrough as will be hereinafter explained more in detail. Furthermore, in this first preferred embodiment of the shield 40, a diametrically opposite and identical radial cutout 48 is formed, the shield at that location extending longitudinally spaced transversely outwardly of an end of the latch driving mechanism 16, again for purposes to be hereinafter explained more in detail. It will also be noted that the shield 40 in its transverse extension and longitudinal abutment with the guard collar 36 transversely underlies the entire of the guard collar and longitudinally abuts a major portion of that guard collar for secure assembly and support therewith.

Continuing with the description of the somewhat conventional remaining structure and assembly of the latch construction, the interior operator 12 includes a dished, annular reinforcing plate 50 having a longitudinally outwardly, partially overlying backing plate 52. A pair of primary fasteners 54 are end engaged with the reinforcing and backing plates 50 and 52 extending longitudinally through the latch driving mechanism 16 and being threadably engaged into the lock cylinder 26 of the exterior operator 10. Thus, the primary fasteners 54 retain the lock cylinder 26 and the lock plug 28 in the assembly with the lock cylinder inwardly abutting the guard collar 36 as described and the guard collar inwardly abutting the shield 40 retaining it against the door exterior surface 20 as described.

A multi-layer annular cover 56 of the interior operator 12 longitudinally outwardly abuts the door interior surface 22 outwardly overlying the reinforcing and backing plates 50 and 52, being retained in assembly by a pair of secondary fasteners 58 threadably received in ends of the primary fasteners 54. Centrally, the cover 56 rotatably mounts a longitudinally outwardly and longitudinally inwardly extending hand bar 60. A longitudinally extending torque bar 62 is lost-motion connected to the lock cylinder 26 in usual manner, extends through and is non-rotatably engaged with a crank hub 64 of the latch driving mechanism 16 and is non-rotatably engaged with and telescoped by this interior operator hand bar 60. Thus, again as is usual, rotation of the lock cylinder 26 ultimately causes rotation of the crank hub 64 and rotation of the hand bar 60 directly causes rotation of the crank hub.

The crank hub 64 is rotatably mounted in a pair of stationary, spaced latch frame members 66 and has a radially extending crank arm 68 with an end pivotally connected through a pin 70 to a pair of spaced driving levers 72. The forward ends of the driving levers 72 within a bolt housing 74 are pivotally connected to the rearward end of the deadbolt 18 with the deadbolt being reciprocal within the bolt housing between its extended and retracted positions. Thus, rotation of the crank hub 64 with the driving levers 72 in their rearward positions, the pin 70 downwardly in its rearward notch 76 and the deadbolt 18 in its retracted position, all as shown in full lines in FIG. 1, moves the rearward ends of the driving levers forwardly while the pin moves upwardly from the rearward notch 76 and along the latch frame members 66 moving the deadbolt toward extended position. Ultimately, the rearward ends of the driving levers 72 arrive at forward notch 78 with pin 70 moving downwardly therein and the deadbolt 18 being in its fully extended position as shown in phantom lines in FIG. 1. Withdrawal of the deadbolt 18 from extended to retracted position is just the opposite of that described.

Returning to the importance of the improved shield construction of the present invention, it is seen that with the shield 40 around the rearwardly exposed portion of the latch driving mechanism 16 interiorly of the door 14, that is, around the crank hub 64 and driving levers 72 directly rearwardly of the bolt housing 74, except for the shield radial cutouts 46 and 48, it is virtually impossible to gain access through the door exterior surface 20 at the rearward end of the bolt housing with a probe in an attempt to surreptitiously manipulate the deadbolt 18 through manipulation of the important driving levers 72. Furthermore, when the deadbolt 18 is in its extended position with the rearward ends of the driving levers 72 approximately at the latch frame member forward notch 78 as described or forwardly of the position shown in FIG. 1, it is virtually impossible to similarly gain probe access for manipulating the driving levers despite the shield rearward radial cutout 48. Thus, this first embodiment shield 40 effectively isolates the important operable portions of the latch driving mechanism 16 from surreptitious probe attack through the door exterior surface 20. This is true despite the shield rearward radial cutout 48 for the reasons discussed which rearward radial cutout is provided in the first embodiment shield 40 to adapt the shield for versatile latch construction mounting, that is, despite which direction the latch construction may extend within various doors and to provide the shield for universal use.

In addition to its universal latch shielding use, the shield 40 forms an important functional element in the overall latch construction assembly. It is important that the shield 40 is retained functional in the assembly for its intended use by the inward abutment therewith of the guard collar 36, but the shield also, in turn, forms a solid support for the guard collar transversely throughout a major part of the guard collar. Also, with the lock cylinder 26 retained in assembly by the primary fasteners 54 and the lock cylinder longitudinally inwardly abutting the guard collar 36 maintaining it in abutment longitudinally inwardly against the shield 40, the sole retainment of the guard collar is by the abutments between the lock cylinder and shield so that the guard collar remains relatively rotatable within the assembly. This permits the guard collar 36 to resist attack against the latch construction not only due to its strength and thickness, but also by the fact that it is difficult to attempt to penetrate the same due to its ready rotation, all as previously discussed.

Figure 4:
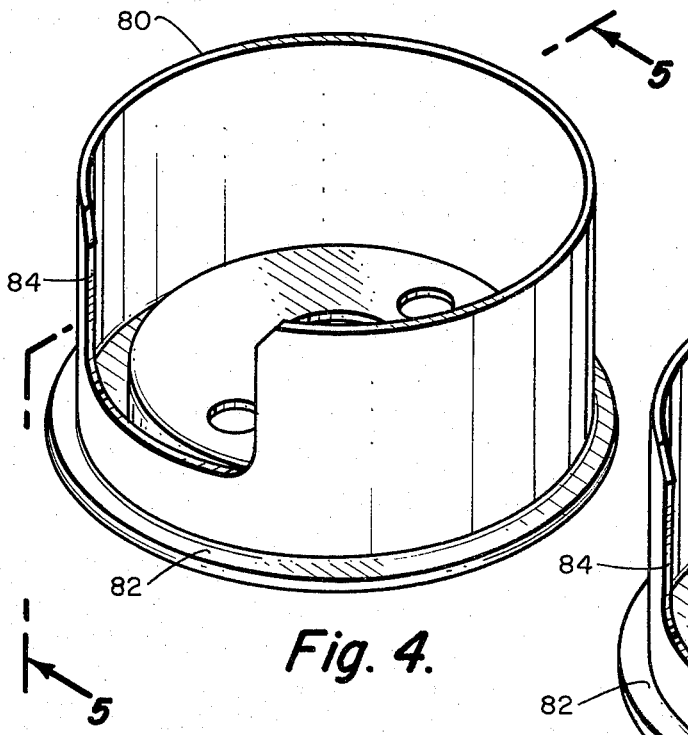
FIG. 4 is a view similar to FIG. 2 and showing a second preferred embodiment of the shield.
Figure 5:
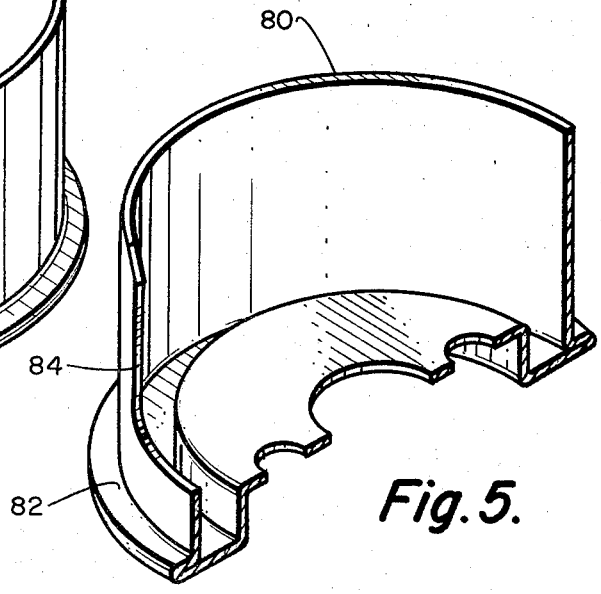
FIG. 5 is a sectional view looking in the direction of the arrows 5—5 in FIG. 4.

A second preferred embodiment of the improved shield construction of the present invention is shown in FIGS. 4 and 5 and is substantially identical to the first embodiment shield 40 with the exception of the elimination of the second or rearward radial cutout 48. As shown, second embodiment shield 80 is of the same configuration, has the same annular abutment shoulder 82 and the same forward radial cutout 84. It will cooperate in the latch construction assembly in the identical manner in all respects with the addition of the added protection by lack of the rearward radial cutout.

According to the principles of the present invention, therefore, an improved shield construction in various preferred forms is provided which efficiently integrates into a usual latch construction assembly and advantageously guards the assembly against surreptitious probe attack through an exterior surface of a door in which the particular latch construction is mounted. The improved shield further cooperates with the latch construction assembly to mount a guard collar thereof in a secure and highly efficient operable manner, all as hereinbefore described. It is pointed out that although the improved shield construction of the present invention has been presented herein integrated into the latch construction assembly in a particular manner and in two preferred embodiment forms, it is not intended to thereby limit the application of the principles of the present invention to the specifics shown, but rather, it is intended that the principles of the present invention be broadly construed only within the limitations as expressly set forth in the appended claims.

I claim:

1. In a latch construction of the type for mounting in doors and the like with a bolt extendable from a door edge, a latch driving mechanism mounted within the door operably connected to the bolt, exterior and interior operators respectively engaged with exterior and interior faces of the door operably connected to the latch driving mechanism and each operable for moving the bolt between extended and retracted positions through movement of the latch driving mechanism, the exterior operator including a lock cylinder telescoping a lock plug and telescoped by a transversely thickened and hardened metal guard collar, longitudinally reactive abutment means between the lock cylinder and the guard collar for the lock cylinder to retain the guard collar longitudinally inwardly in assembly, fastening means longitudinally between the interior and exterior operators retaining the exterior operator in assembly and through the abutment means the guard collar in assembly; the improvement comprising: a metal shield longitudinally outwardly transversely abutting said guard collar and longitudinally inwardly transversely abutting said door exterior face so that said guard collar is retained in assembly by said lock cylinder and fastening means and said shield is retained in assembly by said guard collar, said shield extending longitudinally inwardly into said door interior at least partially annularly around a portion of said latch driving mechanism shielding said latch driving mechanism portion to deter surreptitious manipulation thereof by penetration through the door exterior face.

2. In a latch construction as defined in claim 1 in which said shield has parts thereof extending longitudinally inwardly throughout a major portion of said door interior.

3. In a latch construction as defined in claim 1 in which said shield within said door interior has a cutout formed therein with parts of said latch driving mechanism extending transversely therethrough.

4. In a latch construction as defined in claim 1 in which said shield within said door interior has a first cutout formed therein with parts of said latch driving mechanism extending transversely therethrough, said shield having a second cutout formed therein transversely opposite said first cutout.

5. In a latch construction as defined in claim 1 in which said guard collar is retained in assembly solely by said lock cylinder and shield abutments and is rotatable relative to said lock cylinder and shield.

6. In a latch construction as defined in claim 1 in which said shield transversely inwardly underlies an entire of said guard collar longitudinally abutting a major portion of said guard collar.

7. In a latch construction as defined in claim 1 in which said shield has parts thereof extending longitudinally inwardly throughout a major portion of said door interior; and in which said shield within said door interior has a cutout formed therein with parts of said latch driving mechanism extending transversely therethrough.

8. In a latch construction as defined in claim 1 in which said shield has parts thereof extending longitudinally inwardly throughout a major portion of said door interior; and in which said shield transversely inwardly underlies an entire of said guard collar longitudinally abutting a major portion of said guard collar.

9. In a latch construction as defined in claim 1 in which said shield has parts thereof extending longitudinally inwardly throughout a major portion of said door interior; in which said shield within said door interior has a cutout formed therein with parts of said latch driving mechanism extending transversely therethrough; and in which said shield transversely inwardly underlies an entire of said guard collar longitudinally abutting a major portion of said guard collar.

10. In a latch construction as defined in claim 1 in which said shield has parts thereof extending longitudinally inwardly throughout a major portion of said door interior; and in which said guard collar is retained in assembly solely by said lock cylinder and shield abutments and is rotatable relative to said lock cylinder and shield.

* * * * *